US007746002B2

(12) United States Patent
Van Meurs et al.

(10) Patent No.: US 7,746,002 B2
(45) Date of Patent: Jun. 29, 2010

(54) HIGH FREQUENCY DRIVER FOR GAS DISCHARGE LAMP

(75) Inventors: Johannes Maria Van Meurs, Eindhoven (NL); Dorota Barbara Pawelek, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 473 days.

(21) Appl. No.: 10/597,310

(22) PCT Filed: Jan. 19, 2005

(86) PCT No.: PCT/IB2005/050218

§ 371 (c)(1),
(2), (4) Date: Jul. 20, 2006

(87) PCT Pub. No.: WO2005/072023

PCT Pub. Date: Aug. 4, 2005

(65) Prior Publication Data

US 2007/0182339 A1 Aug. 9, 2007

(30) Foreign Application Priority Data

Jan. 23, 2004 (EP) ..... 04100232

(51) Int. Cl.
*H05B 37/02* (2006.01)

(52) U.S. Cl. ..... 315/209 M

(58) Field of Classification Search ..... 315/244, 315/209 R, 224, 291, 307, DIG. 7, 209 T, 315/209 CD, 209 M, 226
See application file for complete search history.

(56) References Cited

U.S. PATENT DOCUMENTS

| | | | | |
|---|---|---|---|---|
| 4,949,016 | A * | 8/1990 | De Bijl et al. | 315/208 |
| 5,075,599 | A * | 12/1991 | Overgoor et al. | 315/224 |
| 5,138,235 | A * | 8/1992 | Sun et al. | 315/209 R |
| 5,438,243 | A | 8/1995 | Kong | |
| 5,538,243 | A | 7/1996 | Yamamoto et al. | |
| 5,860,015 | A | 1/1999 | Olson | |
| 5,932,976 | A * | 8/1999 | Maheshwari et al. | 315/291 |
| 6,144,172 | A * | 11/2000 | Sun | 315/291 |
| 6,426,597 | B2 * | 7/2002 | Rast et al. | 315/219 |
| 6,437,520 | B1 | 8/2002 | Grouev et al. | |
| 6,518,712 | B2 * | 2/2003 | Weng | 315/209 R |
| 6,593,703 | B2 * | 7/2003 | Sun | 315/224 |
| 6,667,586 | B1 | 12/2003 | Blau | |
| 6,791,281 | B2 * | 9/2004 | Mita | 315/224 |
| 6,906,473 | B2 * | 6/2005 | Alexandrov | 315/224 |

(Continued)

FOREIGN PATENT DOCUMENTS

EP 0114370 A1 8/1984

*Primary Examiner*—Douglas W Owens
*Assistant Examiner*—Minh D A

(57) ABSTRACT

A high frequency driver for a gas discharge lamp is supplied with a DC voltage. The driver converts the input DC voltage to an AC voltage and supplies the AC voltage to a load, which comprises a gas discharge lamp, an inductor connected in series with the lamp and a capacitor connected in parallel to the lamp. The AC voltage has a first high frequency during ignition of the lamp and a second high frequency during normal operation of the lamp after its ignition. The first frequency is higher than the second frequency by a ratio of at least 2.2. By modulating the frequency of the AC voltage the ratio can be increased while still complying with EMI and RFI requirements.

20 Claims, 2 Drawing Sheets

U.S. PATENT DOCUMENTS 6,911,778 B1 * 6/2005 Kroone ..... 315/105
6,965,204 B2 * 11/2005 Langeslag ..... 315/209 R
2002/0041165 A1 4/2002 Cammack
2002/0067145 A1 * 6/2002 Ribarich ..... 315/291
2003/0127995 A1 7/2003 Kramer et al.
2003/0222594 A1 * 12/2003 Mita ..... 315/224
2004/0012347 A1 * 1/2004 Ribarich ..... 315/291

* cited by examiner

HIGH FREQUENCY DRIVER FOR GAS DISCHARGE LAMP

This application is a 371 of PCT/lB 05/50218 01/19/2005.

FIELD OF THE INVENTION

The invention relates to a high frequency driver for a gas discharge lamp, which is in series with an inductor and which has a capacitor connected in parallel to it.

BACKGROUND OF THE INVENTION

"U.S. Pt. No. 5,138,235 discloses a starting and operating circuit for an arc discharge lamp. The circuit comprises a DC power supply means coupled to AC input terminals, oscillator means coupled to said DC power supply to receive a DC voltage, oscillator staffing means and load means coupled to the output of the oscillator and including an inductor in series with the discharge lamp and a capacitor in parallel to the lamp. Upon switching on an AC power supply to the circuit the capacitor has a low impedance, an initial current through the inductor is high and a voltage across filamentary electrodes at ends of the lamp is high. With said latter voltage being sufficient high the lamp will ignite. Then the impedance of the load will decrease, which is reflected to the operation of the oscillator such that its oscillation frequency decreases from an ignition frequency to a lower normal operating frequency. In one example the ignition frequency is 46 kHz and the normal operating frequency is 25 kHz (according to electronic file of said document). This means a ratio between those frequencies is 1.84."

U.S. Pat. No. 5,438,243 discloses an electronic ballast for instant start gas discharge lamps. The ballast differs from the circuit disclosed by U.S. Pat. No. 5,138,235 in that the oscillator, called inverter in U.S. Pat. No. 5,438,243, comprises at its output a transformer of which the secondary winding supplies several gas discharge lamps in series with series inductors and capacitors. The inverter comprises two switched resonating sections for increasing a resonating frequency to over 50 kHz of the inverter at normal operating of the lamps. According to the document (column 4 lines 33-36): "Increasing the frequency reduces the values of the transformer and the ballast inductor and capacitors. Increasing the frequency also improves the performance and reduces the cost of the ballast."

U.S. Pat. No. 6,437,520 discloses an electronic ballast with cross-coupled outputs, comprising two inverters, of which each inverter provides a low voltage alternating current at an AC output of the other inverter. As an example, at ignition the frequency is 80 kHz and with normal operation the frequency is 40 kHz. This means a ratio between those frequencies is 2.

OBJECT OF THE INVENTION

There is a still growing need for low cost energy saving discharge lamps, often abbreviated to CFL ("Compact Fluorescent Lamp"), in particular CFL-I (a CFL device with integrated driver). There is also a need for such lamps with still smaller sizes and/or less heat dissipation and/or reduced costs. Partly this has been achieved by the development of integrated circuits containing many of the components of a lamp driver. Examples thereof are Philips UBA2021 for use with external oscillator output transistors, and Philips UBA2024 having internal oscillator output transistors. However a major part of the size, heat dissipation and costs of the circuit contained in a CFL-I is caused by the presence of the inductor, which is in series with the lamp.

It is common practice for a designer to increase a frequency of an alternating current flowing through an inductor to obtain a smaller size and/or lower temperature and lower cost of the inductor. Such practice is explicitly disclosed by U.S. Pat. No. 5,438,243, which is mentioned with relevant citation above.

However, the inventors have found that the contrary with respect to expectations takes place when applying said common practice. That is, with increasing oscillating frequency the temperature of the inductor will increase also, and vice versa. Yet, a frequency which is too low to ignite the lamp with, cannot be used.

It is therefore an object of the invention to provide a driver which suits the demands mentioned above while obviating the disadvantages of the prior art.

SUMMARY OF THE INVENTION

"Said object is accomplished in one aspect of the invention by providing a high frequency driver for a gas discharge lamp, which is in series with an inductor and which has a capacitor connected in parallel to it, comprising an oscillator, which has DC input terminals for connecting to a DC source and AC output terminals for connecting to a load comprising the lamp, the inductor and the capacitor, the oscillator oscillating at a first high frequency during ignition of the lamp and the oscillator oscillating at a second high frequency during normal operation of the lamp after its ignition, with the first frequency being higher than the second frequency by a ratio of at least 2.2."

This allows the use of an inductor having one or more of the characteristics of smaller size, reduced costs and reduced temperature. Also, it allows to reduce the size of a compact fluorescent lamp (CFL), in particular a lamp assembly (CFL-I) of such lamp and a driver according to the invention integrated therewith.

According to another aspect the invention there is provided a method according to claim 7.

According to still another aspect of the invention there is provided a gas discharge lamp assembly having a driver according to the invention incorporated therein.

BRIEF DESCRIPTION OF THE DRAWINGS

The invention will become more gradually apparent from the following exemplary description in connection with the accompanying drawings. In the drawings there are shown.

DETAILED DESCRIPTION OF EMBODIMENTS

Figure 1:
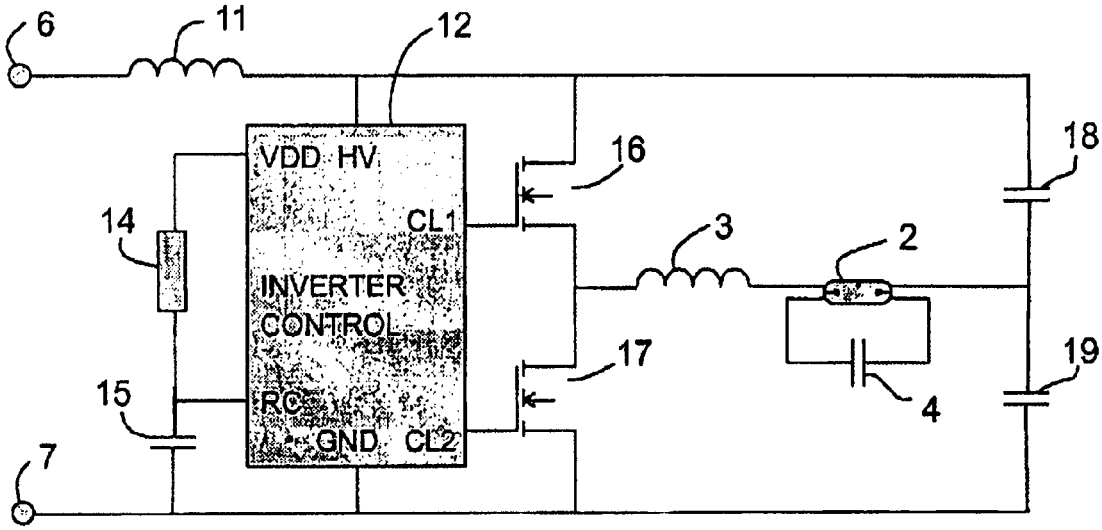
FIG. 1 a schematic diagram of a first embodiment of a high frequency driver which is connected to a gas discharge lamp and which is suitable for applying the invention.

The circuit shown in FIG. 1 comprises a typical high frequency driver in combination with a load which comprises a gas discharge lamp 2, which is in particular a compact fluorescent lamp (CFL). The circuit shown in FIG. 1, lamp 2 inclusive, can be integrated to a single device and is then called a CFL-I.

The driver will not operate without the existence of the lamp 2, an inductor 3 connected in series with the lamp 2 and a capacitor 4 connected in parallel to the lamp 2. Therefore the series circuit of the inductor 3 and the lamp 2 having capacitor 4 connected in parallel to it can be considered as both a load of the driver and as part of the driver as well.

The circuit shown in FIG. 1 comprises terminals 6 and 7 for receiving a high DC positive voltage and ground voltage respectively. These high DC voltage and ground can be supplied by a rectifier bridge (not shown) which has terminals to be connected to the AC voltage of the mains.

A first terminal of an inductor 11 is connected to supply voltage terminal 6. A second terminal of inductor 11 is connected to an input HV of an inverter control 12, such as an integrated circuit UBA2021 manufactured by Philips. A ground input GND of the inverter control 12 is connected to ground terminal 7. Inverter control 12 generates a relatively low positive DC voltage which is provided at an output VDD. A series circuit of a resistor 14 and a capacitor 15 is connected between said output VDD and ground terminal 7, with the resistor 14 connected to output VDD. A connection node between the resistor 14 and the capacitor 15 is connected to an input RC of the inverter control 12.

Inverter control 12 has control or clock outputs CL1 and CL2 which are connected to the gates of field effect transistors (FETs) 16 and 17 respectively. FETs 16 and 17 are connected in series with a drain of FET 16 connected to the high voltage input HV of inverter control 12 and with a source of FET 17 connected to ground terminal 7. An intermediate node of FETs 16 and 17 is connected to a terminal of the load comprised of the lamp 2, the inductor 3 and capacitor 4. The other terminal of said load is connected through a capacitor 18 to the high voltage input HV of inverter control 12 and through another capacitor 19 to ground terminal 7. Capacitors 18 and 19 are for DC decoupling.

Capacitor 4, also called lamp capacitor, only serves during ignition of the lamp 2. Inductor 3, also called ballast inductor or choke, serves during ignition of the lamp and during normal operation of the lamp 2 for stabilizing a current through the lamp 2.

Values of resistor 14 and capacitor 15 determine in combination with the other components as shown an ignition frequency $f_{ig}$ and a normal operating frequency $f_{op}$ at which the circuit will oscillate upon applying a DC voltage to terminals 6 and 7. Upon providing a DC power supply voltage to terminals 6 and 7 the capacitor has a low impedance, an initial current through the inductor is high and a voltage across filamentary electrodes at ends of the lamp 2 is high. With said latter voltage being sufficient high the lamp will ignite. Then the impedance of the load will decrease, which is reflected to the operation of the oscillator such that its oscillation frequency decreases from an ignition frequency to a lower normal operating frequency $f_{op}$.

Of all components of the driver circuit shown in FIG. 1, that is except for lamp 2, inductor 3 is the most bulky one. That is, the size of a housing containing the driver circuit is dominantly determined by the size of inductor 3. Inductor 3 may comprise a ferrite core, possibly of E-shape such as an EE14 core, carrying a winding having a number of turns. When the components of the driver circuit are dimensioned such that the ignition frequency $f_{ig}$ is increased, the number of turns of inductor 3 which are necessary to generate the same sufficient ignition voltage as before is decreased. Then, with the dimensions of inductor 3 not being decreased, the losses in inductor 3 will decrease too. Accordingly the temperature of inductor 3 and, as a consequence, the temperature of the driver circuit and its housing will decrease too. In turn this is important when designing small driver circuits which are to be incorporated with a lamp, known as CFL-I, for specific powers of the lamp.

As an alternative, by increasing the ignition frequency and decreasing the number of turns of inductor 3 while accepting the losses and temperature rise because of that of inductor 3 at levels as before, the size of inductor 3 can be made smaller.

Therefore it will be a trade off for a designer in optimizing a preferable combination of reduced losses and temperature rise in inductor 3 and reduced size of inductor 3.

"It is widely believed that increasing the frequency allows to reduce the values of such an inductor and of capacitors. An explicit statement of this can be found in U.S. Pat. No. 5,438,243, column 4 lines 33-35."

However, the inventors have found that when the ignition frequency is increased beyond some level losses in the core of the inductor 3 will increase. It is common practice that an increase of the ignition frequency $f_{ig}$ will increase the normal or stationary operating frequency $f_{op}$ also and therefore the losses in inductor 3, in particular losses in core and wire, during normal operation will increase too. Therefore the inventors considered that there must be an optimum combination of ignition frequency $f_{ig}$, normal operation frequency $f_{op}$ and acceptable losses.

Because FETs 16, 17 switches explicitly on or off a lot of harmonics will be generated which may cause radio frequency interference (RFI) and electromagnetic interference (EMI) with other electrical equipment. Therefore it will be necessary that a driver circuit is designed such as to keep RFI and EMI within international standards.

Figure 3:
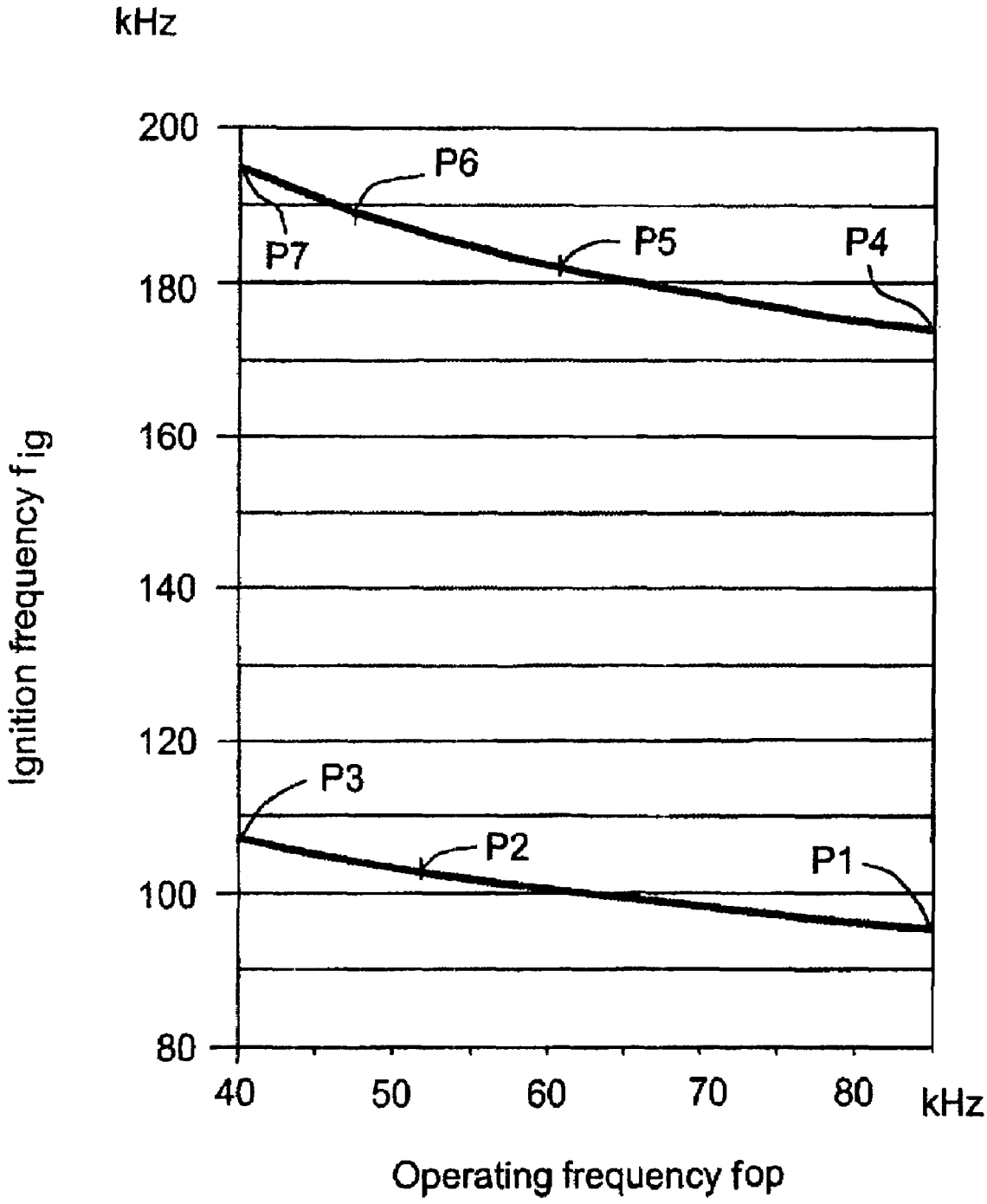
FIG. 3 a diagram of examined pairs of an ignition frequency and an operating frequency for use with said first and second embodiments of a high frequency driver shown in FIGS. 1 and 2.

From simulation by computer and practical experiments the inventors measured the temperature of inductor 3 having an EE-14 core for different combinations of the ignition frequency $f_{ig}$ and normal operating frequency $f_{op}$. The results for three out of many of such combinations P1, P2 and P3 are given in table I below and are indicated in FIG. 3.

TABLE I

| point of curve | $f_{ig}$ [kHz] | $f_{op}$ [kHz] | $R = f_{ig}/f_{op}$ | T [° C.] |
|---|---|---|---|---|
| P1 | 96 | 85 | 1.1 | 60 |
| P2 | 104 | 52 | 2 | 32 |
| P3 | 107 | 40 | 2.7 | 25 |

"It is to be noted that the temperature T indicated in Table I is a temperature rise above ambient temperature of the driver circuit. The inventors considered that a temperature rise of inductor 3 about 30°C. would be acceptable. This means that the ratio $R=f_{ig}/f_{op}$ of the ignition frequency and the normal operating frequency should be about 2.2 or greater."

With higher frequencies than those mentioned in Table I, it is not possible to comply with RFI and EMI standards.

Figure 2:
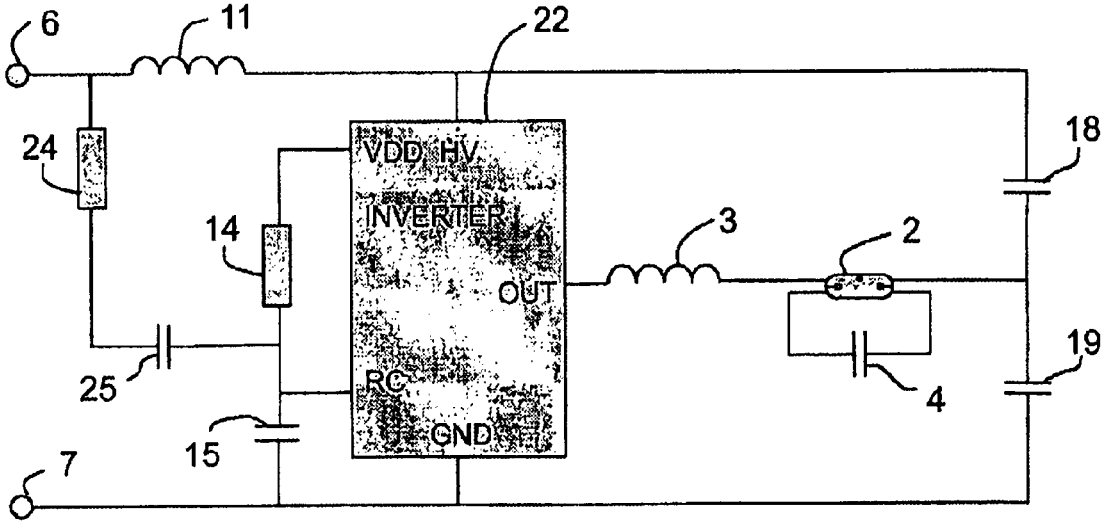
FIG. 2 a schematic diagram of a second embodiment of a high frequency driver which is connected to a gas discharge lamp and in which the invention has been applied.

FIG. 2 shows a driver circuit which is similar to that shown in FIG. 1. The circuit shown in FIG. 2 comprises an inverter 22 which replaces inverter control 12 and FETs 16, 17 of FIG. 1. That is, inverter 22 has driver transistors integrated therewith and the common node OUT supplies a high voltage alternating current to inductor 3. Inverter 22 can be an integrated circuit UBA2024 manufactured by Philips.

The driver circuit shown in FIG. 2 further comprises a series circuit of a resistor 24 and a capacitor 25 connected between the high DC voltage terminal 6 and the input RC of inverter 22. Capacitor 25 decouples for DC voltage. Therefore a ripple of essentially two times the mains frequency will be supplied from terminal 6 to input RC of inverter 22. This causes the output frequency to be frequency modulated by the frequency of said mains ripple.

By modulating the frequency of the current supplied to lamp 2 the energy contained in harmonics due to switching of driving transistors in said current will be smeared out over a larger frequency range. It is found that by doing so much higher ignition frequencies can be used while still complying with RFI and EMI standards.

The inventors have calculated and carried out practical experiments resulting in several combinations of ignition frequency $f_{ig}$, $f_{op}$ and temperature rise of inductor 3 using a modulating frequency of 100 Hz and a modulating ratio of 7% by which the driver circuit shown in FIG. 2 still complies with RFI and EMI standards. Herein, the frequency ratio is defined with respect to a maximum frequency $f_{max}$ and a minimum frequency $f_{min}$ of the output current through conductor 3, in particular by $(f_{max}-f_{min})/(f_{max}+f_{min})\times 100\%$. The combinations P4-P7 found are given in Table II below and are indicated in FIG. 3.

TABLE 3

| point of curve | $f_{ig}$ [kHz] | $f_{op}$ [kHz] | $R = f_{ig}/f_{op}$ | T [° C.] |
|---|---|---|---|---|
| P4 | 174 | 85 | 2 | 26 |
| P5 | 183 | 61 | 3 | 18 |
| P6 | 188 | 47 | 4 | 16 |
| P7 | 195 | 40 | 4.9 | 15 |

From Table II and FIG. 3 it is obvious that a huge increase of the ignition frequency can be obtained by applying modulation of the frequency of the current through lamp 2. Such an increase of ignition frequency, while keeping the normal operating frequency identical to that used in the driver circuit shown in FIG. 1, the size of inductor 3 and/or its losses and temperature rise can be reduced remarkably. This will give a designer much more room to find an optimum design for its goal.

Inverter control 12 of the driver circuit shown in FIG. 1 and inverter 22 of the driver circuit shown in FIG. 2 may consist of integrated circuits, such as UBA2021 and UBA2024 by Philips respectively, which can be programmed or otherwise designed to carry out specific operations to attain specific ignition and normal operation conditions. Therefore it will be obvious that inverter control 12 and inverter 22 may comprise internal circuits to generate ignition and normal operating frequencies as required on the fly and to generate a modulating frequency and modulating ratio having values different from those mentioned above.

"The inventors found that the ratio R =fig/fop is preferably in a range between 2.2and 7. More preferably the ratio is about 5."

The inventors also found that a modulating frequency of less than 15% of an average of the oscillating frequency will do fine.

It is observed that, although the invention has been described with reference to some embodiments shown in the drawings, several modifications can be carried out by a person skilled in the art within the true spirit and scope of the invention as defined by the appended claims. For example, frequencies for ignition, normal operation and modulation could all be generated and monitored by internal circuitry of an integrated circuit which drives the load of lamp 2, inductor 3 and capacitor 4.

The invention claimed is:

1. A high frequency driver for a gas discharge lamp that includes a capacitor in parallel to the lamp and an inductor that is in series with the parallel connection of the lamp and capacitor, comprising an oscillator that includes DC input terminals for connecting to a DC source and AC output terminals for connecting to a load comprising the lamp, the inductor and the capacitor, the oscillator providing a lamp voltage at a first high oscillating frequency during ignition of the lamp and at a second high oscillating frequency during normal operation of the lamp after its ignition, wherein at least one of the first and second oscillating frequencies is frequency modulated.

2. The driver according to claim 1, wherein a ratio of the first high oscillating frequency to the second high oscillating frequency is in a range of 2.2 to 7.

3. The driver according to claim 1, wherein the ratio is approximately 5.

4. The driver according to claim 1, wherein the oscillating frequency is frequency modulated with less than 15% of an average of the oscillating frequency.

5. The driver according to claim 4, wherein the oscillating frequency is frequency modulated with approximately 7% of the average of the oscillating frequency.

6. The driver according to claim 4, wherein the oscillating frequency is frequency modulated at a modulating frequency that is derived from an AC supply to the DC source.

7. The driver of claim 1, wherein the first and second high oscillating frequencies are frequency modulated.

8. The driver of claim 1, wherein a ratio of the first high oscillating frequency to the second high oscillating frequency is greater than 2.2.

9. A method for driving a gas discharge lamp via an oscillator that includes DC input terminals for connecting to a DC source and AC output terminals for connecting to a load comprising an inductor in series with a parallel connection of the lamp and a capacitor, the method including:

providing a lamp voltage at a first high oscillating frequency during ignition of the lamp and providing the lamp voltage at a second high oscillating frequency during normal operation of the lamp after its ignition, wherein at least one of the first and second high oscillating frequencies is frequency modulated.

10. The method according to claim 9, wherein a ratio of the first high oscillating frequency to the second high oscillating frequency is in a range of 2.2 to 7.

11. The method according to claim 9, wherein the ratio is approximately 5.

12. The method according to claim 9, wherein the oscillating frequency is frequency modulated with less than 15% of an average of the oscillating frequency.

13. The method according to claim 12, wherein the oscillating frequency is frequency modulated with approximately 7% of the average of the oscillating frequency.

14. The method according to claim 12, wherein the oscillating frequency is frequency modulated at a modulating frequency that is derived from an AC supply to the DC source.

15. The method of claim 9, wherein the first and second high oscillating frequencies are frequency modulated.

16. The method of claim 9, wherein a ratio of the first high oscillating frequency to the second high oscillating frequency is greater than 2.2.

17. A gas discharge lamp assembly comprising:

a capacitor, a gas discharge lamp coupled in parallel to the capacitor, an inductor that is in series with the lamp and capacitor, a DC supply circuit, and a driver that includes an oscillator that includes DC input terminals coupled to the DC source and AC output terminals connected to a load comprising the lamp, the inductor, and the capacitor, the oscillator providing a lamp voltage at a first high oscillating frequency during ignition of the lamp and at a second high oscillating frequency during normal operation of the lamp after its ignition, wherein at least one of the first and second oscillating frequencies is frequency modulated.

18. The assembly of claim 17, wherein the first and second high oscillating frequencies are frequency modulated.

19. The assembly of claim 17, wherein a ratio of the first high oscillating frequency to the second high oscillating frequency is greater than 2.2.

20. The assembly of claim 19, wherein the ratio is less than 7.

* * * * *